US009867246B2

(12) United States Patent
Aliakseyeu et al.

(10) Patent No.: US 9,867,246 B2
(45) Date of Patent: Jan. 9, 2018

(54) METHODS AND APPARATUS FOR LIFETIME EXTENSION OF LED-BASED LIGHTING UNITS

(71) Applicant: PHILIPS LIGHTING HOLDING B.V., Eindhoven (NL)

(72) Inventors: Dzmitry Viktorovich Aliakseyeu, Eindhoven (NL); Philip Steven Newton, Waalre (NL); Tim Dekker, Eindhoven (NL); Bartel Marinus Van De Sluis, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/901,454

(22) PCT Filed: Jul. 1, 2014

(86) PCT No.: PCT/IB2014/062745

§ 371 (c)(1),
(2) Date: Dec. 28, 2015

(87) PCT Pub. No.: WO2015/001472

PCT Pub. Date: Jan. 8, 2015

(65) Prior Publication Data

US 2016/0374167 A1 Dec. 22, 2016

Related U.S. Application Data

(60) Provisional application No. 61/841,962, filed on Jul. 2, 2013.

(51) Int. Cl.
*H05B 37/02* (2006.01)
*H05B 33/08* (2006.01)

(52) U.S. Cl.
CPC ..... *H05B 33/0845* (2013.01); *H05B 33/089* (2013.01); *H05B 37/0227* (2013.01); *H05B 37/0272* (2013.01); *H05B 37/0281* (2013.01)

(58) Field of Classification Search
CPC H05B 33/0845; H05B 37/02; H05B 37/0218; H05B 37/0227
(Continued)

(56) References Cited

U.S. PATENT DOCUMENTS 6,153,980 A 11/2000 Marshall et al.
6,611,244 B1 8/2003 Guritz
(Continued)

FOREIGN PATENT DOCUMENTS

EP 2456286 A1 5/2012

*Primary Examiner* — Jason M Crawford
(74) *Attorney, Agent, or Firm* — Akarsh P. Belagodu

(57) ABSTRACT

Methods and apparatus for lighting control. One or more properties of light output of one or more LEDs (124A, 124B, 124C, 124N) of an LED node (120A, 120B, 120C, 120N) of an LED-based lighting unit (110) are controlled to extend the lifetime of the LED-based lighting unit. For example, an LED node controller controlling an LED may determine whether the LED will be operated in the active light emitting state based on an LED activation probability. Thus, based on the LED activation probability the LED may at some times be in the active light emitting state and provide light output and may at other times be prevented from being in the active light emitting state and prevented from providing light output.

20 Claims, 5 Drawing Sheets

(58) Field of Classification Search
USPC ..... 315/149–155, 291, 294, 297, 302, 315/307–308
See application file for complete search history.

(56) References Cited

U.S. PATENT DOCUMENTS

| | | | | |
|---|---|---|---|---|
| 7,315,139 | B1 * | 1/2008 | Selvan | H05B 33/086 250/205 |
| 7,557,524 | B2 | 7/2009 | Chevalier et al. | |
| 7,839,295 | B2 | 11/2010 | Ries, II | |
| 8,314,566 | B2 | 11/2012 | Steele et al. | |
| 8,514,210 | B2 * | 8/2013 | Roberts | G09G 3/3426 315/308 |
| 2008/0224966 | A1 * | 9/2008 | Cok | G09G 3/32 345/82 |
| 2009/0128060 | A1 * | 5/2009 | Ries, II | H05B 33/0842 315/312 |
| 2010/0096993 | A1 * | 4/2010 | Ashdown | F21V 29/004 315/113 |
| 2010/0277077 | A1 | 11/2010 | Pong et al. | |
| 2011/0047337 | A1 * | 2/2011 | Busse | H05B 37/03 711/154 |
| 2012/0320627 | A1 | 12/2012 | Araki et al. | |
| 2014/0361696 | A1 * | 12/2014 | Siessegger | H05B 33/0803 315/186 |

* cited by examiner

METHODS AND APPARATUS FOR LIFETIME EXTENSION OF LED-BASED LIGHTING UNITS

CROSS-REFERENCE TO PRIOR APPLICATIONS

This application is the U.S. National Phase application under 35 U.S.C. §371 of International Application No. PCT/IB2014/062745, filed on Jul. 1, 2014, which claims the benefit of U.S. Provisional Patent Application No. 61/841,962, filed on Jul. 2, 2013. These applications are hereby incorporated by reference herein.

TECHNICAL FIELD

The present invention is directed generally to lighting control. More particularly, various inventive methods and apparatus disclosed herein relate to controlling one or more properties of light output of one or more LEDs of an LED node to extend the lifetime of an LED-based lighting unit.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

It is desirable to extend the lifetime of LED light sources with an LED-based lighting unit. It may be particularly desirable to extend the lifetime of the LED-based lighting unit in certain installation locations and/or in certain installation scenarios, for example when installed in a difficult to reach area (e.g., a tunnel and/or in street lighting), to have a relatively long lifetime, to thereby lessen the frequency with which the LED-based lighting unit would need to be serviced and/or replaced.

To extend lifetime, some conventional LED-based lighting units utilize redundant LEDs that are activated if primary LEDs become inoperable. For example, current flowing to a primary LED may be shunted to a redundant LED upon failure of the primary LED. Such a technique requires complete failure of a primary LED prior to activation of the redundant LED and may present one or more drawbacks. For example, such a technique may result in uneven light output in an LED-based lighting unit between a newly activated redundant LED and a broken-in primary LED; may hasten the failure of the primary LED; and/or may result in more serious issues to the LED-based lighting unit upon failure of the primary LED.

To extend lifetime, some other conventional LED-based lighting units utilize a temperature sensor to sense an overheat situation that may be detrimental to the lifetime of one or more LEDs and switch off the one or more LEDs and/or reduce the light output of the one or more LEDs in response to the overheat situation. Such a technique may present one or more drawbacks such as requiring temperature sensors that may reduce reliability of the LED-based lighting unit and/or causing non-uniformly distributed light output in some situations.

To extend lifetime, yet other conventional LED-based lighting units switch between LEDs of the LED-based lighting unit based on a determined cumulative energized time of each of the LEDs to minimize the cumulative energized time of each of the LEDs. Such switching is done in a strictly predefined manner that requires a central controller and a control network between the LED nodes of the LED-based lighting unit. Such a technique may present one or more drawbacks such as necessitating a central controller be utilized, necessitating a control network between the LED nodes, and/or requiring that the switching be performed in a strictly predefined manner.

Thus, there is a need in the art to provide methods and apparatus that enable control of one or more properties of light output of one or more LEDs of an LED node of an LED-based lighting unit to extend the lifetime of the LED-based lighting unit and that may optionally overcome one or more drawbacks of existing techniques.

SUMMARY

The present disclosure is directed to lighting control. More particularly, various inventive methods and apparatus disclosed herein relate to controlling one or more properties of light output of one or more LEDs of an LED node of an LED-based lighting unit to extend the lifetime of the LED-based lighting unit. For example, in some embodiments, an LED node controller controlling an LED may determine whether the LED will be operated in the active light emitting state based on an LED activation probability. Thus, based on the LED activation probability, the LED may at some times be in the active light emitting state and provide light output and may at other times be prevented from being in the active light emitting state and prevented from providing light output. When multiple LED nodes of an LED-based lighting unit implement such techniques, the LED-based lighting unit may during a first time period provide desired uniformity of light output via a first group of activated LEDs, while preventing a second group of the LEDs of the LED-based lighting unit from being activated. The LED-based lighting unit may further, at a second time period (e.g., following a cycle of power after the first time period) provide desired uniformity of light output via a third group of activated LEDs including one or more LEDs unique from the first group, while preventing a fourth group of the LEDs including one or more LEDs unique from the second group from being activated. Such techniques enable lifetime extension of the LED-based lighting unit via varying which LEDs are providing light output at certain time periods via pseudo-random LED activation determinations made at each LED-node based on LED activation probability. Moreover, in some embodiments such techniques may optionally be implemented without necessitating a central controller be utilized to particularly direct which LEDs are activated and which LEDs are non-activated.

Generally, in one aspect a lighting system is provided and includes: a plurality of LED nodes, each of the LED nodes including an LED node controller; and at least one LED controlled by the LED node controller. Each LED node controller: selectively enables the at least one controlled LED to be in an active light emitting state and selectively preventing the at least one controlled LED from being in the active light emitting state; controls the at least one controlled LED based on one or more control parameters, the control parameters including an LED activation probability and the controlling including determining whether the at least one LED is in the active light emitting state based on the LED activation probability; configured to receive an external light level input providing an indication of a desired level of light output; and determines at least one of the control parameters based on the external light level input.

In some embodiments, the at least one of the control parameters determined based on the light level input is the LED activation probability. In some versions of those embodiments, the LED activation probability is proportional to the desired level of light output indicated by the light level input. In some versions of those embodiments, the light level input is pulse width modulated input and the indication of the desired level of light output is based on the duty cycle of the pulse width modulated input. In some of those versions, the system further includes an LED driver providing the pulse width modulated input to each said LED node controller.

In some embodiments, the one or more said LED node controllers each further: determines, based on the light level input, a number of LED nodes in an LED node cluster including the LED node of the LED node controller and one or more additional LED nodes; determines, based on the light level input, a number of LEDs in the LED node cluster to activate; and ensures the number of LEDs in the LED node cluster are activated. In some versions of those embodiments, the number of the one or more LEDs of the LED node cluster to activate is proportional to the desired level of light output.

In some embodiments, the at least one of the control parameters determined based on the light level input is an LED light output level of the at least one controlled LED. In some versions of those embodiments, the LED activation probability is a fixed probability. In some versions of those embodiments, each LED node controller implements the LED light output level via a driving signal provided by the LED node controller to the at least one controlled LED. In some of those versions, the driving signal is a pulse width modulated output. In some versions of those embodiments, the light level input is a pulse width modulated LED driver input and the indication of the desired light output level is based on a duty cycle of the pulse width modulated LED driver input. In some versions of those embodiments, the light level input is a driving signal and wherein the LED node controller implements the LED light output level via providing the driving signal to the at least one controlled LED.

In some embodiments, each LED node controller determines each time the external light level input is cycled, whether the at least one controlled LED will be in the active light emitting state based on the LED activation probability.

In some embodiments, the light level input is provided via a power input utilized to power the LEDs of the LED nodes. In some versions of those embodiments, the lighting system further includes an LED driver generating the light level input.

Generally, in another aspect, a method of controlling an LED of an LED node is provided and includes the steps of: receiving an external light level input providing an indication of a desired level of light output; determining one or more control parameters of an LED of an LED node based on the light level input; determining an LED activation probability of the control parameters, the LED activation probability indicative of a probability the LED of the LED node will be in a light-emitting state; controlling the LED of the LED node based on the control parameters, the controlling including determining whether the LED will be in the light-emitting state based on the LED activation probability.

In some embodiments, determining one or more control parameters of the LED of the LED node based on the light level input includes determining the LED activation probability based on the light level input. In some versions of those embodiments, the determined LED activation probability is proportional to the desired level of light output indicated by the light level input. In some versions of those embodiments, the light level input is pulse width modulated input and the indication of the desired level of light output is based on the duty cycle of the pulse width modulated input.

In some embodiments, the method further includes the steps of: determining, based on the light level input, a number of LED nodes in an LED node cluster including the LED node and one or more additional LED nodes; determining, based on the light level input, a number of LEDs in the LED node cluster to activate; and ensuring the number of the LEDs of the LED node cluster are activated. In some versions of those embodiments, the determined number of the one or more LEDs in the LED node cluster to activate is inversely proportional to the desired level of light output.

In some embodiments, determining one or more control parameters of the LED of the LED node based on the light level input includes determining an LED light output level of the at least one controlled LED based on the light level input. In some versions of those embodiments, the LED activation probability is a fixed probability. In some versions of those embodiments, the method further includes the step of implementing the LED light output level via a driving signal provided by the LED node controller to the at least one controlled LED. In some of those versions, the driving signal is a pulse width modulated output. In some versions of those embodiments, the light level input is a driving signal and further comprising implementing the LED light output level via providing the driving signal to the at least one controlled LED.

In some embodiments, the method further includes determining, each time the external light level input is cycled, whether the at least one controlled LED will be in the active light emitting state based on the LED activation probability. In some versions of those embodiments, the light level input is provided via a power input utilized to power the LEDs of the LED nodes.

In some embodiments, the method further includes the step of determining, each time an occurrence is received, whether the at least one controlled LED will be in the active light emitting state based on the LED activation probability. In some versions of those embodiments, the light level input is provided via a power input to the LED node and the occurrence is provided via the power input.

Other embodiments may include a non-transitory computer readable storage medium storing instructions executable by a processor to perform a method such as one or more of the methods described herein. Yet other embodiments may include memory and one or more processors operable to execute instructions, stored in the memory, to perform a method such as one or more of the methods described herein.

As used herein for purposes of the present disclosure, the term "LED" should be understood to include any electroluminescent diode or other type of carrier injection/junction-based system that is capable of generating radiation in response to an electric signal and/or acting as a photodiode.

Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above).

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
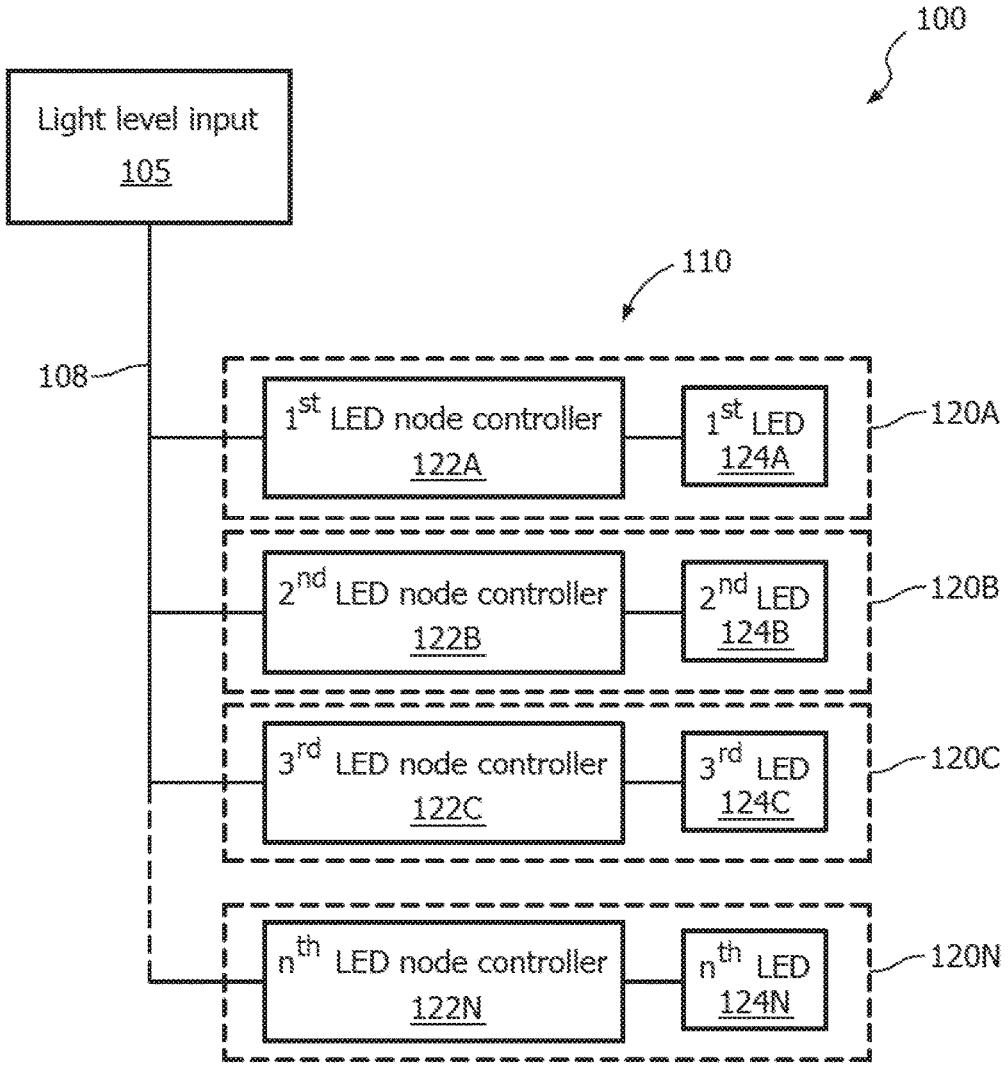
FIG. 1 illustrates a block diagram of an embodiment of an LED-based lighting system having a light level input provided to an LED-based lighting unit having a plurality of LED nodes; each of the LED nodes may control LEDs thereof based on one or more control parameters including an LED activation probability.

In an LED-based lighting unit that includes LEDs, it may be desirable to extend the lifetime of the LED-based lighting unit. For example, it may be desirable to extend the lifetime of the LED-based lighting unit in certain installation locations and/or in certain installation scenarios. For example, it may be desirable for an LED-based lighting unit installed in a difficult to reach area to have a relatively long lifetime, to lessen the frequency with which the LED-based lighting unit would need to be serviced and/or replaced.

To extend lifetime, some LED-based lighting units utilize redundant LEDs that are activated if primary LEDs become inoperable. To extend lifetime, some other LED-based lighting units utilize a temperature sensor to sense an overheat situation that may be detrimental to the lifetime of one or more LEDs and switch off the one or more LEDs and/or reduce the light output of the one or more LEDs in response to the overheat situation. To extend lifetime, yet other LED-based lighting units switch between LEDs of the LED-based lighting unit based on a determined cumulative energized time of each of the LEDs to minimize the cumulative energized time of each of the LEDs. Such techniques may present one or more drawbacks.

Thus, Applicants have recognized and appreciated a need in the art to provide methods and apparatus that enable control of one or more properties of light output of one or more LEDs of an LED node of an LED-based lighting unit to extend the lifetime of the LED-based lighting unit and that may optionally overcome one or more drawbacks of existing techniques.

In view of the foregoing, various embodiments and implementations of the present invention are directed to intelligent lighting control.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are described in conjunction with LED nodes having a single LED node controller controlling a single LED. However, one or more aspects of the methods and apparatus described herein may be implemented in LED-based lighting units having one or more LED nodes that each include more than one LED node controller and/or LED. For example, in some embodiments a single LED node controller of an LED node may control two or more LEDs. Such control may be individually tailored to each of the two or more LEDs and/or each of the two or more LEDs may be controlled in the same manner (e.g., all ON or all OFF). Implementation of the one or more aspects described herein in alternatively configured environments is contemplated without deviating from the scope or spirit of the claimed invention. Also, for example, aspects of the methods and apparatus disclosed herein are described in conjunction with certain embodiments of a light level input. However, one or more aspects of the methods and apparatus described herein may be implemented in combination with other light level inputs providing additional and/or alternative functionality beyond that described herein.

FIG. 1 illustrates a block diagram of an embodiment of an LED-based lighting system 100 having a light level input 105 provided to an LED-based lighting unit 110 via wiring 108. The light level input 105 is indicative of a desired level of light output to be provided by the LED-based lighting unit 110. The wiring 108 is coupled to each of a plurality of LED nodes 120A-N of the LED-based lighting unit 110. Each of the LED nodes 120A-N includes a respective LED node controller 122A-N controlling a respective LED 124A-N. As discussed herein, one or more of the LED node controllers 122A-N may each control a respective of the LEDs 122A-N based on one or more control parameters including an LED activation probability that is utilized to determine whether the respective of the LEDs 122A-N is in an active light emitting state.

One or more of the control parameters, such as the LED activation probability, may be determined based on the light level input 105 provided via wiring 108. For example, the first LED node controller 122A may determine whether the first LED 124A is in the active light emitting state based on an LED activation probability determined based on the light level input 105. For example, the light level input 105 may be indicative of a desired light level output of the LED-based lighting unit 110 that is approximately 50% of a maximum light level output. Based on the desired light level output, the first LED node controller 122A may determine the LED activation probability to be 50%, and determine whether to activate the first LED 124A based on the LED activation probability. For example, the first LED node controller 122A may determine whether to activate the first LED 124A, wherein the likelihood of activating the first LED 124A is approximately 50%.

Various techniques may be utilized to determine whether an LED is in the active light emitting state based on the LED activation probability. For example, the first LED node controller 122A may generate a random number from a set of numbers and determine that the first LED 124A will be activated if the random number equals a number from a subset of the set of numbers. The subset of the numbers may be defined based on the LED activation probability. For example, the set of numbers may be 1-10 and the subset of numbers may be 1-5 for an LED activation probability of 50%. Additional and/or alternative techniques for determining whether an LED is in the active light emitting state based on the LED activation probability may be utilized, such as one or more of the techniques discussed herein.

The light level input 105 may at least selectively include an indication of a desired level of light output that is not individually tailored to the individual LED nodes 120A-N, but, instead, indicates a single desired level of light output for the LED-based lighting unit 110 that each LED node 120A-N may individually process as described herein. In some embodiments the wiring 108 comprises power wiring that also supplies power to the LED nodes 120A-N. In some versions of those embodiments the light level input may be sent to the LED-nodes 120A-N via a pulse-width modulated signal provided via wiring 108. For example, the duty cycle of the pulse-width modulated signal provided via wiring 108 may be indicative of the desired level of light output. For example, a 50% duty cycle may be indicative of a 50% light output level. In some other versions of those embodiments the light level input may be sent to the LED-nodes 120A-N via a direct current non-pulse-width modulated signal provided via wiring 108. For example, the voltage level of the signal provided via wiring 108 may be indicative of the desired level of light output.

In some versions of the embodiments where the wiring 108 comprises power wiring that also supplies power to the LED nodes 120A-N, the light level input 105 may be generated by an LED driver. The LED driver may determine the light level input based on received input, such as input from one or more sensors (e.g., an occupancy sensor, a daylight sensor), a dimming interface, and/or a lighting control system.

In some embodiments, the wiring 115 comprises wiring that is distinct from the power wiring that also supplies power to the LED nodes 120A-N. In some versions of those embodiments the light level input 105 may be sent via analog signal dimming over the distinct wiring. In some other versions of those embodiments the light level input 105 may be sent via digital signal dimming. For example, some embodiments may utilize the Digital Addressable Lighting Interface (DALI) protocol and/or other digital protocol. Embodiments that utilize wiring that is distinct from the power wiring may utilize one or more individual wires to provide light level input 105 to the LED nodes 120A-N. In some versions of the embodiments that utilize wiring that is distinct from the power wiring, the light level input 105 may at least selectively include group light level input 105 that is directed to all of the LED nodes 120A-N. In some versions of the embodiments that utilize wiring that is distinct from the power wiring, the light level input 105 may additionally and/or alternatively include individual lighting control commands that are individually addressed to individual of the LED nodes 120A-N. In some versions of the embodiments that utilize wiring that is distinct from the power wiring, the light level input 105 may be based on received input, such as input from one or more sensors (e.g., an occupancy sensor, a daylight sensor), a dimming interface, and/or a lighting control system.

In some embodiments wiring 108 is omitted and the light level input 105 is provided wirelessly. For example, in some embodiments the light level input 105 may be provided to LED nodes 120A-N via radio-frequency (RF) communications utilizing one or more protocols, such as Zigbee and/or EnOcean. LED node controllers 122A-N may include or be coupled to wireless communication interfaces to enable receipt of any RF communications. In some versions of the embodiments that utilize wireless communications, the light level input 105 may at least selectively be directed to all of the LED nodes 120A-N. In some versions of the embodiments that utilize wireless communications, the light level input 105 may additionally and/or alternatively include individual lighting control commands that are individually addressed to individual of the LED nodes 120A-N.

Figure 2:
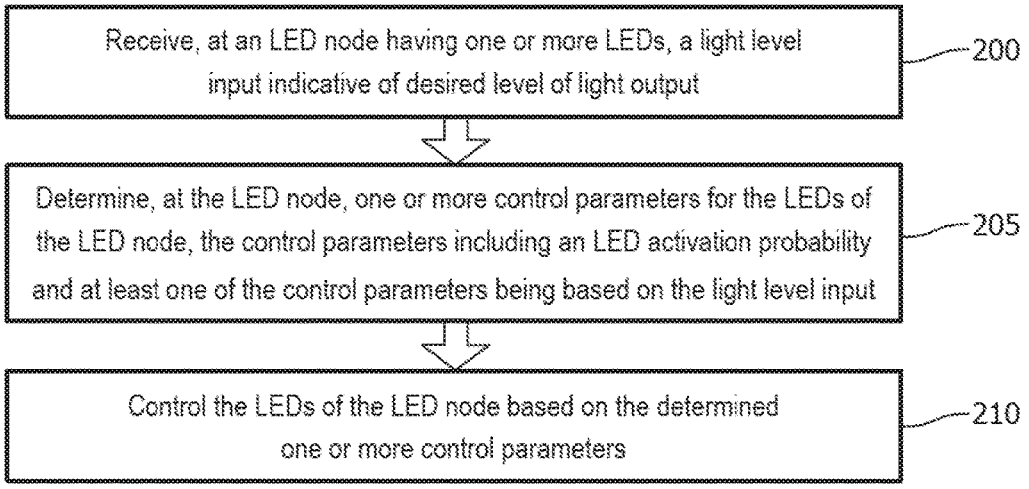
FIG. 2 illustrates a flow chart of an embodiment of controlling an LED node of an LED-based lighting unit based on one or more control parameters including an LED activation probability.
Figure 3:
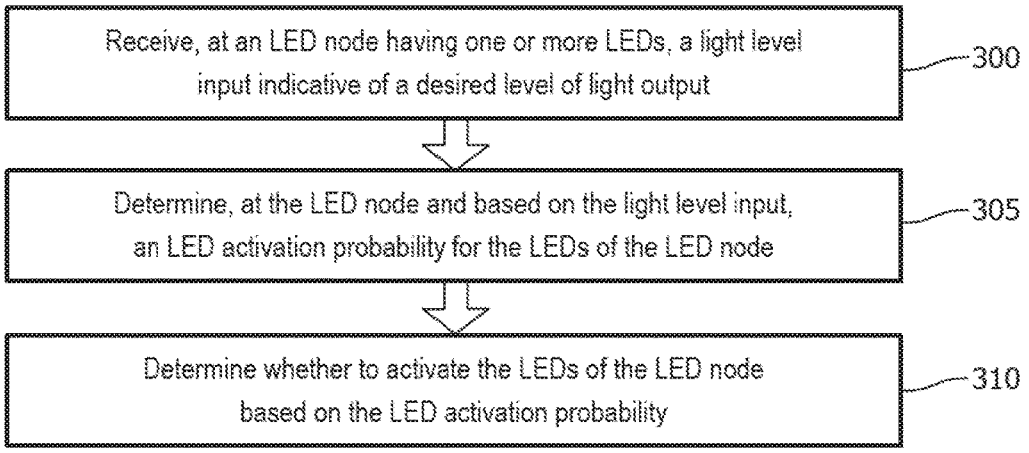
FIG. 3 illustrates a flow chart of an embodiment of controlling an LED node of an LED-based lighting unit based on an LED activation probability determined based on a light level input.
Figure 5:
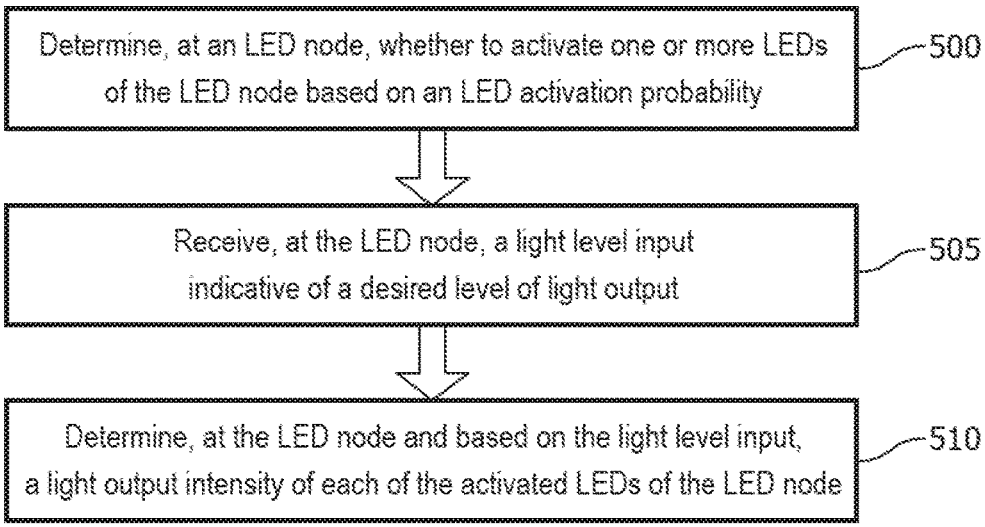
FIG. 5 illustrates a flow chart of an embodiment of controlling an LED node of an LED-based lighting unit based on an LED activation probability and based on an LED light output level determined based on a light level input.
Figure 6:
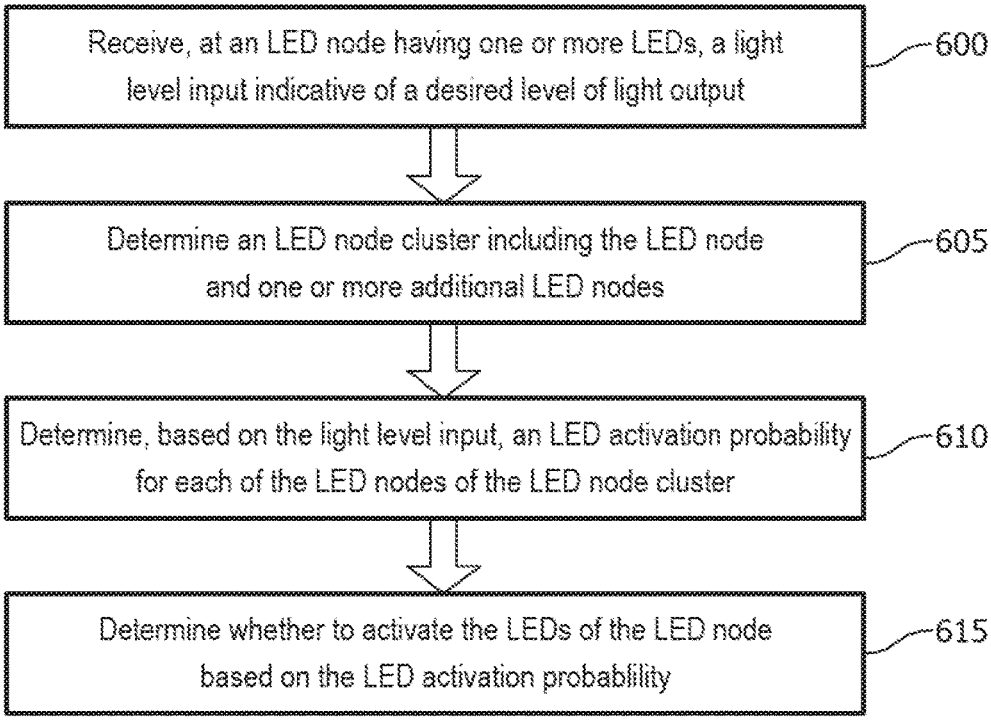
FIG. 6 illustrates a flow chart of an embodiment of determining an LED node cluster of an LED-based lighting unit and determining an LED activation probability for the LEDs in the LED node cluster based on the light level input.

Referring to FIG. 2, a flow chart of an embodiment of controlling an LED node of an LED-based lighting unit based on one or more control parameters including an LED activation probability is provided. Other implementations may perform the steps in a different order, omit certain steps, and/or perform different and/or additional steps than those illustrated in FIG. 2. For convenience, aspects of FIG. 2 will be described with reference to one or more components of an LED-based lighting unit that may perform the method. The components may include, for example, one or more of the LED node controllers 122A-N of FIG. 1. Accordingly, for convenience, aspects of FIG. 1 will be described in conjunction with FIG. 2. It is noted that the flow charts of FIGS. 3, 5, and 6 provide example versions of the embodiment of the flow chart of FIG. 2.

At step 200, a light level input is received at an LED node that is indicative of a desired level of light output. For example, light level input 105 may be received by first LED node controller 122A via wiring 108. As discussed herein, in some embodiments the light level input may be received via power wiring that also supplies power to the LED node. In some versions of those embodiments the light level input may be pulse-width modulated input for driving the LED of the LED node and the desired level of light output may be indicated by the duty cycle of the pulse-width modulated input.

At step 205, one or more control parameters for the LEDs of the LED node are determined at the LED node. For example, first LED node controller 122A may determine one or more control parameters for the first LED 124A. The control parameters include an LED activation probability. At least one of the control parameters is based on the light level input received at step 200. As described herein (e.g., FIGS. 3 and 6), in some embodiments the LED activation probability may be determined based on the light level input received at step 200. In some embodiments additional and/or alternative control parameters may be determined based on the light level input received at step 200. For example, as described herein (e.g., FIG. 5), in some embodiments an LED light output level control parameter may be determined based on the light level input received at step 200. In some versions of those embodiments the LED activation probability may be a fixed probability.

At step 210, one or more LEDs of the LED node are controlled based on the one or more control parameters determined at step 205. For example, first LED node controller 122A may control the first LED 124A based on one or more determined control parameters. For example, the first LED node controller 122A may determine whether the LED 124A will be in the active light emitting state based on the LED activation probability. For example, the first LED node controller 122A may generate a random number from a set of numbers and determine that the first LED 124A will be activated if the random number equals a number from a subset of the set of numbers. The subset of the numbers may be defined based on the LED activation probability. For example, the set of numbers may be whole numbers 1-10 and the subset of numbers may be 1, 3, 5, 7, and 9 for an LED activation probability of 50%. Also, for example the first LED node controller 122A may generate a random voltage from a set of voltages and determine that the first LED 124A will be activated if the random voltage matches a voltage from a subset of the voltages. For example, the set of voltages may be 1.0 Volt, 1.5 Volts, 2.0 Volts, 2.5 Volts, 3.0 Volts, and 3.5 Volts and the subset of voltages may be 1.0 Volt for an LED activation probability of 20%. Additional and/or alternative techniques for determining whether an LED is in the active light emitting state based on the LED activation probability may be utilized.

Determination of whether an LED is in the active light emitting state based on the LED activation probability may be made in response to one or more occurrences. For example, in some embodiments each time power is cycled (e.g., removed and reapplied) from the LED-based lighting unit 110 for at least a threshold period of time, the first LED node controller 122A may determine whether the LED 124A is in the active light emitting state. Also, for example, in some embodiments when power is cycled according to certain criteria (e.g., removed and reapplied at least X times in a Y second interval), the first LED node controller 122A may determine whether the LED 124A is in the active light emitting state. As discussed, in some embodiments the power that is cycled may be the power that is providing the light level input (e.g., via PWM).

Also, for example, in some embodiments when an occurrence message is provided in a signal being provided to the first LED node controller 122A, the first LED node controller 122A may determine whether the LED 124A is in the active light emitting state. For example, an occurrence message may be encoded in a pulse-width modulated driving signal being provided to the first LED node controller 122A utilizing, for example, an increased and/or decreased voltage level in some of the cycles of the pulse-width modulated driving signal. Also, for example, an occurrence message may be encoded in a non-pulse-width modulated driving signal being provided to the first LED node controller 122A utilizing, for example, an increased and/or decreased voltage level during certain time periods of the driving signal.

Also, for example, an occurrence message may be provided wirelessly and/or via wiring that is distinct from the wiring providing power to the LED node controller 122A. For example, one or more data packets sent wirelessly and/or via wiring that is distinct from the wiring providing power to the LED node controller 122A may trigger the first LED node controller 122A to determine whether the LED 124A is in the active light emitting state. In some versions of those embodiments, the light level input may optionally also be provided via the same communications medium (e.g., via data packets provided wirelessly and/or via wiring that is distinct from the wiring providing power to the LED node controller 122A).

Also, for example, in some embodiments the LED-based lighting unit 110 may receive input from a timer and/or other sensor and, in response to certain input the first LED node controller 122A, may determine whether the LED 124A is in the active light emitting state. For example, the LED-based lighting unit 110 may include an internal timer that provides input to the LED node controllers 122A-N at one or more intervals to cause the LED nodes 122A-N to determine whether the LEDs 124A-N are in the active light emitting state. Also, for example, the LED-based lighting unit 110 may include an ambient temperature sensor that provides input to the LED node controllers 122A-N and the LED nodes 122A-N will determine whether the LEDs 124A-N are in the active light emitting state based on the received input. For example, every time the temperature sensor input initially indicates a temperature reading that is a whole number that is a factor of 5, the LED nodes 122A-N will determine whether the LEDs 124A-N are in the active light emitting state. Additional and/or alternative techniques for triggering determination of whether an LED is in the active light emitting state based on the LED activation probability may be utilized.

It will be appreciated that, upon each occurrence that causes determination of whether an LED is in the active light emitting state based on the LED activation probability, a new determination of the activation state is made. Accordingly, assuming a sufficient number of occurrences and an LED activation probability that is indicative of less than a 100% probability, but greater than 0% probability of activating the LED of the LED node, after some of the occurrences the LED will be activated, while after other of the occurrences the LED will not be activated. For example, for an LED of an LED node, assuming a fixed LED activation probability of 50% and one thousand occurrences, after approximately 50% of the occurrences the LED will be activated and after approximately 50% of the occurrences the LED will not be activated.

Additional control parameters in addition to LED activation probability may be utilized. For example, as described with respect to FIG. 5, in some embodiments the first LED node controller 122A may determine an LED light output level of the LED 124A and cause the LED 124A to be operated at the LED light output level. In some embodiments the light output level may be based on the light level input received at step 200.

In some embodiments each of the LED nodes may include a driver to drive the LEDs base on the determined one or more control parameters. In some embodiments one or more LED drivers may be provided, each providing power to multiple LED nodes, and the LED controllers of the LED nodes may determine whether a driving signal provided by the respective LED driver is provided to the LEDs thereof based on the control parameters. In some embodiments where the light level input is provided via powering wiring providing power to the LED nodes, the controllers of the LED nodes may determine whether a driving signal provided by the LED nodes is provided to the LEDs thereof based on the control parameters.

Referring to FIG. 3, a flow chart of an embodiment of controlling an LED node of an LED-based lighting unit based on an LED activation probability determined based on a light level input is provided. FIG. 3 provides an example version of the flow chart of FIG. 2. Other implementations may perform the steps in a different order, omit certain steps, and/or perform different and/or additional steps than those illustrated in FIG. 3. For convenience, aspects of FIG. 3 will be described with reference to one or more components of an LED-based lighting unit that may perform the method. The components may include, for example, one or more of the LED node controllers 122A-N of FIG. 1. Accordingly, for convenience, aspects of FIG. 1 will be described in conjunction with FIG. 3.

At step 300 a light level input is received at an LED node that is indicative of a desired level of light output. For example, light level input 105 may be received by first LED node controller 122A via wiring 108. Step 300 may share one or more aspects in common with step 200 of FIG. 2.

At step 305, an LED activation probability control parameter for the LEDs of the LED node is determined at the LED node. The LED activation probability is based on the light level input received at step 300. For example, in some embodiments the LED activation probability may be determined based on the following formula:

LED activation probability=(desired level of light output indicated by light level input)/(*N**light output contribution of the LED node to the LED-based lighting unit);

wherein N is indicative of the total number of LEDs in the LED-based lighting unit. For example, assuming a desired level of light output of 70% indicated by the light level input, a total number of LEDs of the LED-based lighting unit of 100, and a light output contribution of the LED node to the LED-based lighting unit of 1% (e.g., 1/100, assuming that the LED node has one LED and that each of the LEDs of the LED based lighting unit provides the same light output level), the LED activation probability may be determined based on the following equation:

LED activation probability=(70%)/(100*0.01)=70%.

As another example, assuming a desired level of light output of 70% indicated by the light level input, a total number of LEDs of the LED-based lighting unit of 100 and a light output light output contribution of the LED node to the LED-based lighting unit of 2% (e.g., 2/100, assuming that two LEDs are provided in the LED node and that each of LEDs of the LED based lighting unit provides the same light output level), the LED activation probability may be determined as follows:

LED activation probability=(70%)/(100*0.02)=35%.

Although percentages of light output are utilized above, and elsewhere in this specification in expressing light output, it is understood that in some embodiments light output may alternatively be expressed in other manners. For example, in some embodiments the desired level of light output indicated by light level input may be expressed in lumens and the light output contribution of the LED node to the LED-based lighting unit may be expressed in lumens.

In some embodiments, to maintain uniformity of light output and/or for other considerations, a minimum level of LED activation probability may be identified for one or more light level inputs and/or a maximum level of LED activation probability may be identified for one or more light level inputs. Accordingly, in some embodiments the LED-based lighting unit will have a minimum level of light output that may be provided. For example, in some embodiments if the desired level of light output indicated by light level input is less than 20%, then the LED activation probability may be set to a default level such as 20%. Also, for example, in some embodiments if the LED-based lighting unit will have a maximum level of light output that may be provided. For example, in some embodiments if the desired level of light output indicated by light level input is greater than 80%, then the LED activation probability may be set to a default level such as 80%. Additional and/or alternative minimum and/or maximum LED activation probabilities based on additional and/or alternative light level inputs may be utilized. Step 305 may share one or more aspects in common with step 205 of FIG. 2

At step 310, it is determined whether to activate the LEDs of the LED node based on the LED activation probability determined at step 305. For example, the first LED node controller 122A may determine whether the LED 124A will be in the active light emitting state based on the LED activation probability. For example, the first LED node controller 122A may generate a random number from a set of numbers and determine that the first LED 124A will be activated if the random number equals a number from a subset of the set of numbers identified based on the LED activation probability. Also, for example the first LED node controller 122A may generate a random voltage from a set of voltages and determine that the first LED 124A will be activated if the random voltage matches a voltage from a subset of the voltages identified based on the LED activation probability. Additional and/or alternative techniques for determining whether an LED is in the active light emitting state based on the LED activation probability may be utilized.

Determination of whether an LED is in the active light emitting state based on the LED activation probability may be made in response to one or more occurrences such as those discussed herein. For example, in some embodiments each time power is cycled from the LED-based lighting unit 110 for at least a threshold period of time, the first LED node controller 122A may determine whether the LED 124A is in the active light emitting state. Also, for example, in some embodiments when power is cycled according to certain criteria, the first LED node controller 122A may determine whether the LED 124A is in the active light emitting state. Also, for example, in some embodiments when a message is provided in a signal being provided to the first LED node controller 122A, the first LED node controller 122A may determine whether the LED 124A is in the active light emitting state. Also, for example, in some embodiments the LED-based lighting unit 110 may receive input from a timer and/or other sensor and, in response to certain input, the first LED node controller 122A may determine whether the LED 124A is in the active light emitting state.

It will be appreciated that, upon each occurrence that causes determination of whether an LED is in the active light emitting state based on the LED activation probability, a new determination of the activation state is made. Accordingly, assuming a sufficient number of occurrences and an LED activation probability that is indicative of less than a 100% probability, but greater than 0% probability of activating the LED of the LED node, after some of the occurrences the LED will be activated, while after other of the occurrences the LED will not be activated. Step 310 may share one or more aspects in common with step 210 of FIG. 2.

Figure 4A:
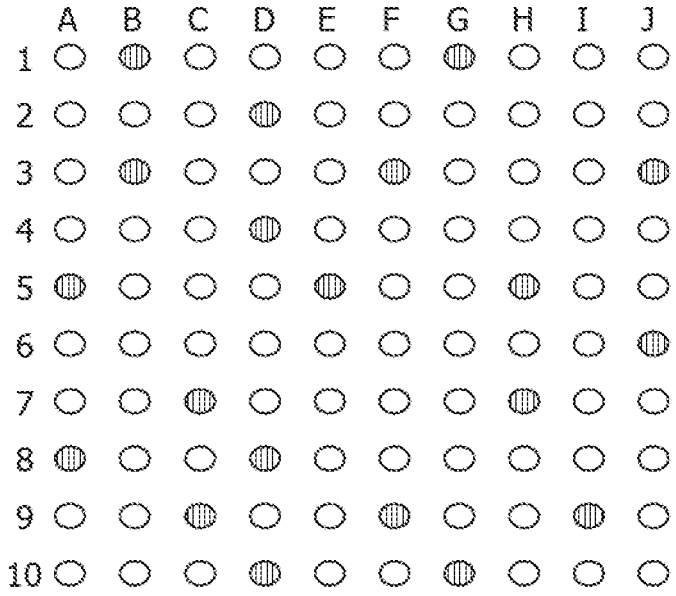
FIG. 4A illustrates an example of activation states of LEDs of each LED node in a ten by ten array of LED nodes based on a determined activation probability of twenty percent.

FIG. 4A illustrates an example of activation states of LEDs of each LED node in a ten by ten array of LED nodes based on a determined LED activation probability of twenty percent. The activation state of each of the LED nodes may be determined utilizing the embodiment of FIG. 3. Each circle in the array indicates an LED node and activated LED nodes are indicated with shading. For example, the LED node in row 1, column B is activated, while the LED node in row 2, column C is not activated. As illustrated, twenty of the LED nodes are indicated as being activated. It is understood that in some embodiments more than or fewer than twenty of the LED nodes may be activated based on a determine LED activation probability of twenty percent. For example, it may be the case that each of the individual nodes determined whether to activate LEDs thereof based on an LED activation probability as described herein, but only eighteen of the LED nodes were eventually activated based on such a determination. However, based on stochastic theory, on average, approximately twenty of the LEDs nodes will be activated. It will be appreciated that upon each occurrence that causes determination of whether an LED is in the active light emitting state based on the LED activation probability, a new determination of the activation state is made. Accordingly, if the LED activation probability remains at 20% and an occurrence causes a new determination of whether the LEDs of FIG. 4A are activated, it is very likely that a unique set of the LEDs of FIG. 4A will be activated in response to such an occurrence. Based on stochastic theory, it is likely that on average, over a sufficient time period, the average cumulative energized time for each LED node of FIG. 4A will be similar.

Figure 4B:
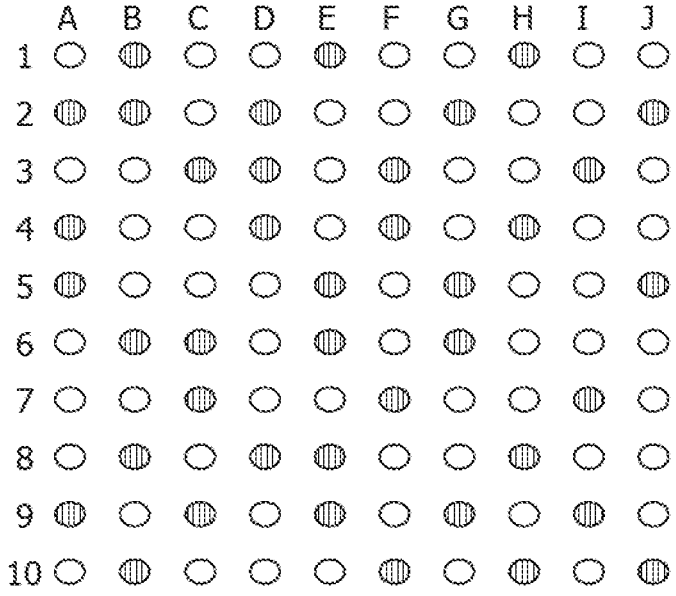
FIG. 4B illustrates an example of activation states of LEDs of each LED node in a ten by ten array of LED nodes based on a determined activation probability of forty percent.

FIG. 4B illustrates an example of activation states of LEDs of each LED node in a ten by ten array of LED nodes based on a determined activation probability of forty percent. The activation state of each of the LED nodes may be determined utilizing the embodiment of FIG. 3. Like FIG. 4A, each circle in the array indicates an LED node and activated LED nodes are indicated with shading. As illustrated, forty of the LED nodes are illustrated as being activated. It is understood that in some embodiments more than or fewer than forty of the LED nodes may be activated based on a determined LED activation probability of forty percent. However, based on stochastic theory, on average, approximately forty of the LEDs nodes will be activated. It will be appreciated that upon each occurrence that causes determination of whether an LED is in the active light emitting state based on the LED activation probability, a new determination of the activation state is made. Accordingly, if the LED activation probability remains at 40% and an occurrence causes a new determination of whether the LEDs of FIG. 4B are activated, it is very likely that a unique set of the LEDs of FIG. 4B will be activated in response to such an occurrence. Based on stochastic theory, it is likely that on average, over a sufficient time period, the average cumulative energized time for each LED node of FIG. 4B will be similar.

Referring to FIG. 5, a flow chart of an embodiment of controlling an LED node of an LED-based lighting unit based on an LED activation probability and controlling the LED node based on a light output level determined based on a light level input is provided. FIG. 5 provides another example version of the flow chart of FIG. 2. Other implementations may perform the steps in a different order, omit certain steps, and/or perform different and/or additional steps than those illustrated in FIG. 5. For convenience, aspects of FIG. 5 will be described with reference to one or more components of an LED-based lighting unit that may perform the method. The components may include, for example, one or more of the LED node controllers 122A-N of FIG. 1. Accordingly, for convenience, aspects of FIG. 1 will be described in conjunction with FIG. 5.

At step 500, it is determined whether to activate one or more LEDs of the LED node based on an LED activation probability. Step 500 may share one or more aspects in common with step 310 of FIG. 3 and/or step 210 of FIG. 2. In some embodiments the LED activation probability may be fixed to ensure uniformity of light output from the LED-based lighting unit within which the LED node is implemented. For example, an LED-based lighting unit may include twice the number of LEDs necessary to achieve a desired light output for a lighting scenario in which it is installed. For example, to achieve a 100% desired light output level for the given lighting scenario, it may only be necessary to illuminate 50% of the LEDs of the LED-based lighting unit at a given time. Accordingly, the LED activation probability may be fixed at approximately 50% to take into account such an overpopulation of LEDs. In some embodiments the LED activation probability may be variable, but fixed between one or more ranges to ensure uniformity of light output from the LED-based lighting unit within which the LED node is implemented. For example, to achieve a 100% desired light output level for the given lighting scenario, it may only be necessary to illuminate 60% of the LEDs of the LED-based lighting unit at a given time. Accordingly, the LED activation probability may be variable, but fixed between a range of approximately 55% to 65% to take into account such an overpopulation of LEDs.

Determining whether to activate one or more LEDs of the LED node based on an LED activation probability may be based on one or more techniques such as those described herein with respect to step 310 of FIG. 3. For example, the first LED node controller 122A may determine whether the LED 124A will be in the active light emitting state based on the LED activation probability. For example, the first LED node controller 122A may generate a random number from a set of numbers and determine that the first LED 124A will be activated if the random number equals a number from a subset of the set of numbers identified based on the LED activation probability. Also, for example the first LED node controller 122A may generate a random voltage from a set of voltages and determine that the first LED 124A will be activated if the random voltage matches a voltage from a subset of the voltages identified based on the LED activation probability. Additional and/or alternative techniques for determining whether an LED is in the active light emitting state based on the LED activation probability may be utilized.

Moreover, determination of whether an LED is in the active light emitting state based on the LED activation probability may be made in response to one or more occurrences such as those discussed herein with respect to step 310 of FIG. 3. For example, in some embodiments each time power is cycled from the LED-based lighting unit 110 for at least a threshold period of time, the first LED node controller 122A may determine whether the LED 124A is in the active light emitting state. It will be appreciated that, that upon each occurrence that causes determination of whether an LED is in the active light emitting state based on the LED activation probability, a new determination of the activation state may be made. Accordingly, assuming a sufficient number of occurrences and a fixed LED activation probability of 50%, after approximately 50% of the occurrences the LED will be activated, while after another 50% of the occurrences the LED will not be activated.

At step 505, a light level input is received at the LED node that is indicative of a desired level of light output. For example, light level input 105 may be received by first LED node controller 122A via wiring 108. Step 505 may share one or more aspects in common with step 200 of FIG. 2 and/or step 300 of FIG. 3.

At step 510, a light output intensity of each of the activated LEDs of the LED node is determined based on the light level input. Step 510 may share one or more aspects in common with step 210 of FIG. 2. For example, in some embodiments the light output intensity may be determined based on the following formula: LED light output level=desired level of light output indicated by light level input. For example, if the desired level of light output indicated by the light level input is 70%, then the LED light output level may be 70%. Also, for example, in some embodiments the light output intensity may be determined based on the following formula:

LED light output intensity=(desired level of light output indicated by light level input)/(*N**(light output contribution of the LED node to the LED-based lighting unit);

wherein N is indicative of the total number of LEDs in the LED-based lighting unit. For example, assuming a desired level of light output of 70% indicated by the light level input, a total number of LEDs of the LED-based lighting unit of 100 and a light output contribution of the LED node to the LED-based lighting unit of 1% (e.g., 1/100, assuming that the LED node has one LED and that each of the LEDs of the LED based lighting unit provides the same light output level), the LED activation probability may be determined based on the following equation:

LED light output level=(70%)/(100*0.01)=70%.

In some embodiments the LED light output level may be based on additional and/or alternative factors.

In some embodiments, to maintain desired and/or capable degrees of LED light output and/or for other considerations, a minimum LED light output level may be identified for one or more light level inputs and/or a maximum LED light output level may be identified may be identified for one or more light level inputs. Accordingly, in some embodiments the LED-based lighting unit will have a minimum level of light output that may be provided. For example, in some embodiments if the desired level of light output indicated by light level input is less than 20%, then the LED light output level may be set to a default level such as 20%. Also, for example, in some embodiments if the LED-based lighting unit will have a maximum level of light output that may be provided. For example, in some embodiments if the desired level of light output indicated by light level input is greater than 80%, then the LED light output level may be set to a default level such as 80%. Additional and/or alternative minimum and/or maximum LED light output levels based on additional and/or alternative light level inputs may be utilized.

Referring to FIG. 6, a flow chart of an embodiment of determining an LED node cluster of an LED-based lighting unit based on a light level input and determining an LED activation probability for the LEDs in the LED node cluster based on a light level input is provided. FIG. 6 provides another example version of the flow chart of FIG. 2. Other implementations may perform the steps in a different order, omit certain steps, and/or perform different and/or additional steps than those illustrated in FIG. 6. For convenience, aspects of FIG. 6 will be described with reference to one or more components of an LED-based lighting unit that may perform the method. The components may include, for example, one or more of the LED node controllers 122A-N of FIG. 1. Accordingly, for convenience, aspects of FIG. 1 will be described in conjunction with FIG. 6.

At step 600 a light level input that is indicative of a desired level of light output is received at an LED node having one or more LEDs. For example, light level input 105 may be received by first LED node controller 122A via wiring 108. Step 605 may share one or more aspects in common with step 200 of FIG. 2, step 300 of FIG. 3, and/or step 505 of FIG. 5.

At step 605, an LED node cluster is determined. The LED node cluster includes the LED node and one or more additional LED nodes. In some embodiments the LED node cluster includes the LED node and one or more LED nodes neighboring the LED node. In some embodiments the LED node cluster is defined. For example, in some embodiments an LED node will be defined to be in a cluster with X other neighboring LED nodes. In some embodiments the LED node cluster may be determined based on the light level input received at step 600. For example, in some embodiments the LED node cluster includes Y total LED nodes, including the LED node and other neighboring LED nodes, wherein Y is inversely proportional to the level of light input indicated by the light level input.

Figure 7A:
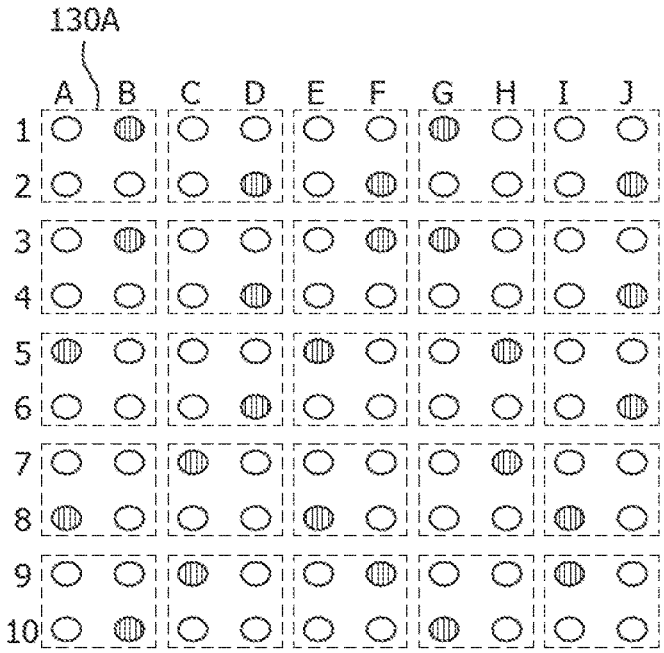
FIG. 7A illustrates an example of determined LED node clusters and activation states of LEDs of each LED node cluster in a ten by ten array of LED nodes based on a determined activation probability of twenty-five percent.
Figure 7B:
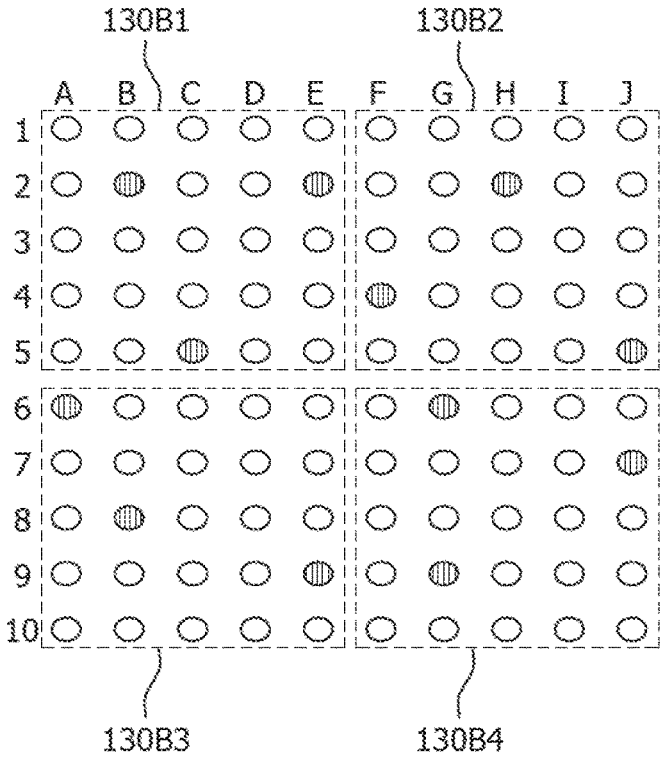
FIG. 7B illustrates an example of determined LED node clusters and activation states of LEDs of each LED node cluster in a ten by ten array of LED nodes based on a determined activation probability of twelve percent.

For example, FIG. 7A illustrates an example of determined LED node clusters that each include four LED nodes (each node represented by a circle). For example, LED node 130A is indicated in FIG. 7A and includes LED nodes in row 1, column A; row 1, column B; row 2, column A; and row 2, column B. Other LED nodes are also indicated in FIG. 7A by dashed rectangles, but do not include a specific reference numeral. In some embodiments the LED node cluster size may be inversely proportional to the level of light output of twenty-five percent of FIG. 7A (1/(75%)). Also, for example, FIG. 7B illustrates an example of determined LED node clusters 130B1, 130B2, 130B3, and 130B4 that each include twenty-five LED nodes (each node represented by a circle). In some embodiments the LED node cluster size may be inversely proportional of the indicated light level input of twelve percent of FIG. 7B (3*(1/(75%))). It is noted that in the preceding example, the inverse of the indicated light level input is multiplied by three to obtain a whole number of LED nodes to include in the LED node cluster. Additional and/or alternative techniques for determining an LED node cluster based on the light level input received at step 600 may be utilized.

At step 610, an LED activation probability control parameter for each of the LED nodes of the LED node cluster is determined. The LED activation probability is based on the light level input received at step 600. For example, in some embodiments the LED activation probability may be determined based on the following formula:

LED activation probability=(desired level of light output indicated by light level input)/(*N**light output contribution of the LED node to the LED-based lighting unit);

wherein N is indicative of the total number of LEDs in the LED-based lighting unit. For example, assuming a desired level of light output of 70% indicated by the light level input, a total number of LEDs of the LED-based lighting unit of 100 and a light output light output contribution of the LED node to the LED-based lighting unit of 1% (e.g., 1/100, assuming that the LED node has one LED and that each of the LEDs of the LED based lighting unit provides the same light output level), the LED activation probability may be determined based on the following equation:

LED activation probability=(70%)/(100*0.01)=70%.

At step 615 it is determined whether to activate one or more LEDs of the LED node based on the LED activation probability determined at step 610. Step 615 may share one or more aspects in common with step 500 of FIG. 5, step 310 of FIG. 3 and/or step 210 of FIG. 2. For example, the first LED node controller 122A may determine whether the LED 124A will be in the active light emitting state based on the LED activation probability. For example, the first LED node controller 122A may generate a random number from a set of numbers and determine that the first LED 124A will be activated if the random number equals a number from a subset of the set of numbers identified based on the LED activation probability. Also, for example the first LED node controller 122A may generate a random voltage from a set of voltages and determine that the first LED 124A will be activated if the random voltage matches a voltage from a subset of the voltages identified based on the LED activation probability. Additional and/or alternative techniques for determining whether an LED is in the active light emitting state based on the LED activation probability may be utilized.

Step 615 may further include determining that at least a minimum number of LEDs in the LED node cluster are activated after each of the LED nodes in the LED node cluster determines whether to activate the respective LEDs. If such minimum number of LEDs is not activated, then one or more LED nodes may activate one or more LEDs of the LED node cluster until such minimum is achieved. The minimum number of LEDs may be based on the number of LED nodes in the LED cluster times the LED activation probability determined at step 615. For example, with respect to FIG. 7A, the number of LEDs in each LED node cluster is four and the LED activation probability is twenty percent. The minimum number of LEDs in FIG. 7A may be one (4*25%). Also, for example, with respect to FIG. 7B, the number of LEDs in each LED node cluster is twenty five and the LED activation probability is twelve percent. The minimum number of LEDs in FIG. 7B may be three (25*12%). Determining that at least a minimum number of LEDs in the LED node cluster are activated may require the LED nodes of a given LED node cluster to be in network communication with one another. For example, the LED nodes of a given LED node cluster may communicate with one another and/or with a determined central LED node controller of the LED node cluster to provide an indication of the activation state of each LED node. Based on such an indication of the activation state of each LED node, one or more controllers of the LED node cluster (e.g., a central LED node controller) may ensure that at least the minimum number of LEDs is activated by causing one or more additional LEDs to be activated to achieve the minimum number of LEDs.

In some embodiments, step 615 may further include determining that no more than a maximum number of LEDs in the LED node cluster are activated after each of the LED nodes in the LED node cluster determines whether to activate the respective LEDs. If more than such maximum number of LEDs is activated, then one or more LED nodes may deactivate one or more LEDs of the LED node cluster until such maximum is achieved. The maximum number of LEDs may be based on the number of LED nodes in the LED cluster times the LED activation probability determined at step 615. For example, with respect to FIG. 7A, the number of LEDs in each LED node cluster is four and the LED activation probability is twenty percent. The maximum number of LEDs in FIG. 7A may be one (4*25%). Also, for example, with respect to FIG. 7B, the number of LEDs in each LED node cluster is twenty five and the LED activation probability is twelve percent. The maximum number of LEDs in FIG. 7B may be three (25*12%). Determining that more than a maximum number of LEDs in the LED node cluster are activated may require the LED nodes of a given LED node cluster to be in network communication with one another. For example, the LED nodes of a given LED node cluster may communicate with one another and/or with a determined central LED node controller of the LED node cluster to provide an indication of the activation state of each LED node. Based on such an indication of the activation state of each LED node, one or more controllers of the LED node cluster (e.g., a central LED node controller) may ensure that no more than a maximum number of LEDs is activated by causing one or more additional LEDs to be activated to achieve the minimum number of LEDs.

Grouping LED nodes into clusters, determining that at least a minimum number of LEDs in an LED node cluster are activated, and/or determining that no more than a maximum number of LEDs in an LED node cluster are activated may achieve desired uniformity of distribution in an LED-based lighting unit.

In some embodiments ensuring that at least a minimum and/or no more than a maximum number of LEDs are activated in an LED node cluster may require the LED nodes of a given LED node cluster to be in network communication with one another and a determined central LED node controller of the LED node cluster to determine which of the LED nodes of the LED node cluster is activated based on an LED activation probability. For example, a central LED node controller may determine whether to activate one or more LED nodes of the LED node cluster based on an LED activation probability based on one or more techniques such as those described herein with respect to step 310 of FIG. 3. For example, the central LED node controller may determine a minimum number of LED nodes to be activated in the LED node cluster and determine whether the LEDs of each LED node will be in the active light emitting state based on the LED activation probability. For example, the central LED node controller may assign a number to each of the LED nodes and generate a number of random numbers from the set of assigned numbers, wherein the number of random numbers is based on the minimum number of LED nodes to be activated. Those LED nodes being assigned numbers that match the one or more generated random numbers may be directed to activate LEDs thereof. For example, for an LED node cluster with four LED nodes, the LED nodes may be assigned numbers 1, 2, 3, and 4. The minimum number of LEDs may be one and one random number may be selected from the assigned numbers 1, 2, 3, and 4. The LED node with the assigned number matching the random number will be directed to activate one or more LEDs thereof. Similar techniques may be utilized utilizing voltages and/or other parameters.

Like other embodiments described herein, determination of whether an LED node is in the active light emitting state based on the LED activation probability may be made in response to one or more occurrences such as those discussed herein with respect to step 310 of FIG. 3.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Reference numerals appearing in the claims between parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A lighting system, comprising:

a plurality of LED nodes, each of the LED nodes including an LED node controller and at least one LED controlled by the LED node controller, each said LED node controller:

selectively enabling the at least one controlled LED to be in an active light emitting state and selectively preventing the at least one controlled LED from being in the active light emitting state;

controlling the at least one controlled LED based on control parameters, the control parameters including an LED activation probability and at least one first parameter assigned to the at least one controlled LED, and the controlling including determining whether the at least one LED is in the active light emitting state based on the LED activation probability;

configured to receive an external light level input providing an indication of a desired level of light output; and determining at least one of the control parameters based on the external light level input, wherein each of said LED controllers is configured to perform said selectively enabling in response to determining that said at least one first parameter matches a randomized parameter that is provided by at least one random parameter generator, wherein a probability that the at least one first parameter matches the randomized parameter is said LED activation probability.

2. The system of claim 1, wherein the at least one of the control parameters determined based on the light level input includes the LED activation probability and the at least one first parameter.

3. The system of claim 2, wherein the LED activation probability is proportional to the desired level of light output indicated by the light level input.

4. The system of claim 2, wherein the light level input is pulse width modulated input and the indication of the desired level of light output is based on the duty cycle of the pulse width modulated input, wherein the system further comprises an LED driver providing the pulse width modulated input to each said LED node controller.

5. The system of claim 2, wherein one or more said LED node controllers each further:

determines, based on the light level input, a number of LED nodes in an LED node cluster including the LED node of the LED node controller and one or more additional LED nodes;

determines, based on the light level input, a number of LEDs in the LED node cluster to activate; and ensures the number of LEDs in the LED node cluster are activated.

6. The system of claim 5, wherein the number of the one or more LEDs of the LED node cluster to activate is proportional to the desired level of light output.

7. The system of claim 1, wherein the at least one of the control parameters determined based on the light level input includes an LED light output level of the at least one controlled LED.

8. The system of claim 1, wherein each LED node controller determines each time the external light level input is cycled, whether the at least one controlled LED will be in the active light emitting state based on the LED activation probability.

9. The system of claim 1, wherein the light level input is provided via a power input utilized to power the LEDs of the LED nodes.

10. A method of controlling an LED of an LED node, comprising:

receiving an external light level input providing an indication of a desired level of light output;

determining one or more control parameters of the LED of the LED node based on the light level input;

determining an LED activation probability of the control parameters, the LED activation probability indicative of a probability the LED of the LED node will be in a light-emitting state;

assigning at least one first parameter to the LED; and controlling the LED of the LED node based on the control parameters, the controlling including determining whether the LED will be in the light-emitting state based on the LED activation probability, wherein the controlling includes activating the LED in response to determining that said at least one first parameter matches a randomized parameter that is provided by at least one random parameter generator, wherein a probability that the at least one first parameter matches the randomized parameter is said LED activation probability.

11. The method of claim 10, wherein determining one or more control parameters of the LED of the LED node based on the light level input includes determining the LED activation probability and the at least one first parameter based on the light level input.

12. The method of claim 11, wherein the determined LED activation probability is proportional to the desired level of light output indicated by the light level input.

13. The method of claim 11, wherein the light level input is pulse width modulated input and the indication of the desired level of light output is based on the duty cycle of the pulse width modulated input.

14. The method of claim 11, further comprising:

determining, based on the light level input, a number of LED nodes in an LED node cluster including the LED node and one or more additional LED nodes;

determining, based on the light level input, a number of LEDs in the LED node cluster to activate; and ensuring the number of the LEDs of the LED node cluster are activated.

15. The method of claim 14, wherein the determined number of the one or more LEDs in the LED node cluster to activate is inversely proportional to the desired level of light output.

16. The method of claim 10, wherein determining one or more control parameters of the LED of the LED node based on the light level input includes determining an LED light output level of the at least one controlled LED based on the light level input.

17. The method of claim 16, wherein the LED activation probability is a fixed probability.

18. The method of claim 10, further comprising determining, each time the external light level input is cycled, whether the at least one controlled LED will be in the active light emitting state based on the LED activation probability.

19. The method of claim 10, further comprising determining, each time an occurrence is received, whether the at least one controlled LED will be in the active light emitting state based on the LED activation probability.

20. A lighting system, comprising:

a plurality of LED nodes, each of the LED nodes including an LED node controller and at least one LED controlled by the LED node controller, each said LED node controller:

selectively enabling the at least one controlled LED to be in an active light emitting state and selectively preventing the at least one controlled LED from being in the active light emitting state:

controlling the at least one controlled LED based on one or more control parameters, the control parameters including an LED activation probability and the controlling including determining whether the at least one LED is in the active light emitting state based on the LED activation probability;

configured to receive an external light level input providing an indication of a desired level of light output; and determining at least one of the control parameters based on the external light level input, wherein at least a subset of said LED node controllers are configured to alternately activate same LEDs of said controlled LEDs multiple times to implement a same total light level output by the system.

* * * * *